US011713148B2

(12) United States Patent
Rapparini et al.

(10) Patent No.: US 11,713,148 B2
(45) Date of Patent: Aug. 1, 2023

(54) PACKAGING OF OBJECTS IN STIFF PACKAGES

(71) Applicant: ICA S.P.A., Bologna (IT)

(72) Inventors: Gino Rapparini, Bologna (IT); Maurizio Generali, Bologna (IT)

(73) Assignee: ICA S.P.A., Bologna (IT)

( * ) Notice: Subject to any disclaimer, the term of this patent is extended or adjusted under 35 U.S.C. 154(b) by 50 days.

(21) Appl. No.: 17/069,059

(22) Filed: Oct. 13, 2020

(65) Prior Publication Data

US 2021/0114755 A1 Apr. 22, 2021

(30) Foreign Application Priority Data

Oct. 17, 2019 (IT) ..... 102019000019178

(51) Int. Cl.

| | |
|---|---|
| ***B65B 43/10*** | (2006.01) |
| ***B65B 5/02*** | (2006.01) |
| ***B65B 5/06*** | (2006.01) |
| ***B65D 5/02*** | (2006.01) |

(52) U.S. Cl.

CPC ..... *B65B 43/10* (2013.01); *B65B 5/024* (2013.01); *B65B 5/06* (2013.01); *B65D 5/0227* (2013.01)

(58) Field of Classification Search

USPC ..... 53/456

See application file for complete search history.

(56) References Cited

U.S. PATENT DOCUMENTS

| | | | | |
|---|---|---|---|---|
| 3,016,807 A | | 1/1962 | Kerr | |
| 4,067,172 A | * | 1/1978 | Paules | B65B 59/00 53/506 |
| 4,480,421 A | | 11/1984 | Rece | 53/75 |
| 4,592,190 A | * | 6/1986 | Sherman | B65B 7/20 493/31 |
| 5,188,695 A | * | 2/1993 | Colton | B65B 51/023 53/76 |
| 5,265,400 A | | 11/1993 | Roberts et al. | 53/500 |

(Continued)

FOREIGN PATENT DOCUMENTS

| | | |
|---|---|---|
| CN | 106864800 | 6/2017 |
| DE | 102017201830 | 8/2018 |

OTHER PUBLICATIONS

Search Report from corresponding Italian Application No. 102019000019178 dated May 11, 2020; 8 pages.

*Primary Examiner* — Chinyere J Rushing-Tucker

(74) *Attorney, Agent, or Firm* — Fattibene and Fattibene, LLC; Paul A. Fattibene

(57) ABSTRACT

A method and a packaging machine for packaging objects in a stiff package, for example in a carton box or in a box, the stiff package comprising a right flap, a left flap, an upper flap and a lower flap. After folding the right, left, and lower flaps in closed position, the upper flap is kept in a semi-closed position so as to only partially overlap the closed lower flap. Glue is then applied to the closed lower flap or semi-closed upper flap. After applying the glue, the upper flap is brought in closed position so that it is fixed to the lower flap. The application of the glue to the lower flap in closed position or to the upper flap in semi-closed position allows adjusting the squaring of the package immediately before bringing the upper flap from the semi-closed position to the closed position, i.e., immediately before fixing the flaps and closing the package.

14 Claims, 12 Drawing Sheets

(56) References Cited

U.S. PATENT DOCUMENTS

| | | | | |
|---|---|---|---|---|
| 6,383,123 | B1 | 5/2002 | Ehring et al. | 493/315 |
| 2005/0081486 | A1* | 4/2005 | Kruger | B31B 50/00 53/376.5 |
| 2015/0183539 | A1* | 7/2015 | Cox | B65B 11/12 53/558 |
| 2018/0222608 | A1 | 8/2018 | Hutter et al. | |
| 2018/0297316 | A1 | 10/2018 | De Maio | B31B 50/804 |

* cited by examiner

PACKAGING OF OBJECTS IN STIFF PACKAGES

FIELD OF THE INVENTION

The present invention relates to the field of packaging objects in stiff packages, for example in carton boxes or boxes. In particular, the present invention relates to the field of packaging objects in stiff packages comprising foldable flaps which are used for closing the packages.

BACKGROUND OF THE INVENTION

Various packaging machines are known in the state of the art for packaging objects in stiff packages, for example carton boxes or boxes made of cardboard or stiff cardboard. Cartoning machines are therefore known, for example, for packaging objects in carton boxes. Casepackers are also known for packaging objects in cardboard boxes. The carton boxes or boxes comprise flaps placed at the openings thereof. The packaging machines operate to fold the flaps in closed position and to fix them with glue in order to close the packages.

The state-of-the-art systems are often very bulky. For example, the state-of-the-art systems provide several aligned stations in which each station is dedicated to the folding of a single flap. This is why the state-of-the-art systems are long and bulky.

Moreover, the state-of-the-art systems are often complex and involve the use of complicated and bulky mechanisms to perform the various operations.

The known systems often involve high risks of damaging the packages during the packaging operations and therefore a high probability of obtaining defective packages, for example with damaged flaps, or packages which are not squared.

The state-of-the-art systems often operate at low speeds.

The present invention addresses one or more of these problems of the background art.

SUMMARY OF THE INVENTION

In the context of the present invention, the terms "right", "left", "upper" and "lower" are defined with respect to the transportation direction of the packages during the operative steps as shown in the accompanying figures. These terms must therefore not be interpreted in a restrictive manner but are used in a simplified manner with respect to the accompanying figures. A change in the point of view with respect to the accompanying figures would in fact entail a change of these terms.

According to an embodiment of the present invention, a method is provided for packaging objects in a stiff package, for example in a carton box or a box, along a transportation line, in which the stiff package comprises a right flap, a left flap, an upper flap and a lower flap, in which the method comprises the following steps:

a) folding the left flap in a closed position;

b) folding the right flap in a closed position;

c) folding the lower flap in a closed position so that the lower flap overlaps the right and left flaps in closed position;

d) folding the upper flap in a predefined semi-closed position so that the upper flap partially overlaps the lower flap in closed position;

e) applying glue to at least one of the lower flap in closed position and the upper flap in semi-closed position; and f) folding the upper flap in a closed position so as to fix the upper flap to the lower flap by means of the glue.

The method according to the present invention can be used to package objects in carton boxes, for example to package capsules for obtaining drinks, for example coffee, in carton boxes. For example, 10 capsules for obtaining drinks can be packaged in each carton box. The method according to the present invention can alternatively be used to package objects in boxes of larger dimensions than the carton boxes. For example, the method according to the present invention can be used to package a certain number of carton boxes, for example 10 carton boxes in boxes.

Steps a) to f) can be performed in the chronological order in which they are listed. Alternatively, for example, steps a) and b) can be performed in reverse chronological order, or simultaneously.

The method according to the present invention can also be carried out on stiff packages which comprise two sets of flaps, i.e., a set of flaps for each opening at each of the two ends of the packages. The various steps can be carried out simultaneously on corresponding flaps placed at the two openings of the packages.

Preferably, no glue is applied to any flap before step e). In other words, step e) is the only glue application step for closing the package.

The application of glue to at least one of the lower flap in closed position and the upper flap in semi-closed position is advantageous because it allows to operate in a compact manner and to reduce the probability of damaging the squaring of the package.

According to a further embodiment of the invention, a method is provided in which during the execution of steps a) and b) the upper flap and the lower flap are kept in an open position in which both the upper flap and the lower flap form an angle greater than 0° with respect to the horizontal direction so that the left flap and the right flap do not interfere with the upper flap and the lower flap during the folding of steps a) and b). This avoids having to interrupt the packaging method. Furthermore, the chances of obtaining defective or improperly closed packages are reduced.

According to a further embodiment of the invention, a method is further provided comprising the following step:

g) adjusting the squaring of the stiff package, in which step g) is carried out between step e) and step f).

In this way it is ensured that the packages are squared even if, for example due to the execution of the previous steps or due to their tendency to return to a flat position, the packages exit from step e) without being squared.

According to a further embodiment of the invention, a method is provided, in which the stiff package is kept squared while step f) is carried out. In this way the package is closed and fixed while it is kept squared in order to ensure that the packages are not defective.

According to a further embodiment of the invention, a packaging machine is provided for packaging objects in stiff packages, for example in carton boxes or boxes, along a transportation line, in which the stiff packages comprise a right flap, a left flap, an upper flap and a lower flap, in which the packaging machine comprises:

a first operative station configured to fold the left flap and the right flap in a closed position;

a second operative station configured to fold the lower flap in a closed position so that the lower flap overlaps the right and left flaps in the closed position and to fold the upper flap in a predefined semi-closed position so that the upper flap partially overlaps the lower flap in closed position;

a third operative station configured to apply glue to at least one of the lower flap in closed position and the upper flap in semi-closed position; and a fourth operative station configured to fold the upper flap in a closed position so as to fix the upper flap to the lower flap by means of the glue.

The packaging machine according to the present invention can be a cartoning machine, i.e., it can be a machine for packaging objects in carton boxes, for example for packaging capsules for obtaining beverages, for example coffee, in carton boxes. For example, 10 capsules for obtaining drinks can be packaged in each carton box.

The packaging machine according to the present invention can alternatively be a casepacker, i.e., it can be a machine for packaging objects in boxes of larger dimensions than the carton boxes. For example, the casepacker can be used to package a certain number of carton boxes, for example 10 carton boxes into boxes.

The packaging machine according to the present invention can also be configured to operate on stiff packages which comprise two sets of flaps, i.e., a set of flaps for each opening at each of the two ends of the packages. The various operative stations can therefore be equipped with mirrored devices so as to simultaneously perform the various operations on corresponding flaps located at the two openings of the packages.

Preferably, upstream of the third operative station there is no operative station for applying glue to the flaps. In other words, the third operative station is the only operative station for applying glue for the closure of the package.

The application of glue to at least one of the lower flap in closed position and the upper flap in semi-closed position is advantageous because it allows to operate in a compact manner and to reduce the probability of damaging the squaring of the package.

The packaging machine according to the present invention is therefore compact. Furthermore, the packaging machine according to the present invention allows to minimize the probability of obtaining defective packages.

According to a further embodiment of the invention, a packaging machine is provided in which the second operative station comprises a first arm configured to rotate around an axis so that the end portion of the first arm pushes the lower flap from an open position to the closed position and a second arm configured to rotate around an axis so that the end portion of the second arm pushes the upper flap from an open position to a closed position in which the upper flap overlaps the lower flap in closed position. The pair of arms allows to efficiently operate in a compact space.

According to a further embodiment of the invention, a packaging machine is provided in which at least one or both end portions of the first arm and the second arm are provided with a roll configured to roll along the surface of the lower flap or of the upper flap while the first arm and/or second arm rotate to push the lower flap or the upper flap, respectively. The use of rolls is particularly advantageous because the probability of damaging the flaps during folding is minimized. In fact, the rolls roll along the surfaces of the flaps starting from the fold line and going towards the ends thereof. This facilitates the folding operation and minimizes the likelihood of damaging the flaps.

According to a further embodiment of the invention, a packaging machine is provided in which the roll is mounted at the end portion of the first arm and/or of the second arm by means of a spring so that the rotation axis of the roll is displaceable in a reversible manner. This allows to further minimize the probability of damaging the flaps during folding since in the event of resistance exerted by the flaps, the roll moves by means of the spring, thus avoiding damage to the flaps.

According to a further embodiment of the invention, a packaging machine is provided in which the third operative station comprises a guide configured to keep the upper flap in the predefined semi-closed position during the transportation of the stiff packages from the second operative station to the third operative station. This effectively avoids the reopening of the flaps during transportation and allows to ensure that the flaps are in the predefined positions thereof when the package reaches the third operative station.

According to a further embodiment of the invention, a packaging machine is provided further comprising glue application means placed underneath the guide so as to be in the free space formed between the lower flap in closed position and the upper flap in predefined semi-closed position. In this manner the further compactness of the packaging machine is ensured.

According to a further embodiment of the invention, a packaging machine is provided further comprising adjusting means for adjusting the squaring of the stiff packages in which the adjusting means are configured to adjust the squaring of the stiff packages after glue has been applied at the third operative station and before the upper flap has been folded at the fourth operative station. In this manner, the probability of obtaining packages which are not squared is minimized.

According to a further embodiment of the invention, a packaging machine is provided in which the adjusting means are configured to keep the stiff packages squared while the upper flap is folded at the fourth operative station. In this manner, the closure by means of glue of packages which are kept squared is ensured in order to considerably reduce the probability of obtaining defective packages.

According to a further embodiment of the invention, a packaging machine is provided in which the adjusting means comprise a first guide and a second guide, the first guide and the second guide are transversally placed with respect to the transportation direction of the packages along the transportation line and are rotatable from a horizontal position which allows the passage of the packages to a vertical squaring position of the packages. In the vertical squaring position of the packages, the first guide and the second guide can be in contact with the side walls of the packages. This allows to be able to activate or deactivate the adjusting operation of the squaring at will.

According to a further embodiment of the invention, a packaging machine is provided in which the first guide and the second guide of the adjusting means are placed at the fourth operative station. In this manner the compactness of the packaging machine is further increased.

According to a further embodiment of the invention, a packaging machine is provided in which the first operative station comprises a first guide with a pointed entry end portion so that when the packages travel along the first guide the upper flap and the lower flap are brought to an open position so as to form an angle greater than 0° with respect to the horizontal direction. In this manner, the left flap and the right flap do not interfere with the upper flap and the lower flap during the folding thereof. This allows to avoid having to interrupt the packaging process. Furthermore, the chances of obtaining defective or improperly closed packages are reduced.

According to a further embodiment of the invention, a packaging machine is provided in which the first guide further comprises a protrusion so that when the packages travel along the first guide, the left flap is brought in closed position.

According to a further embodiment of the invention, a packaging machine is provided in which the first guide further comprises an opening for the passage of pushing means configured to rotate so as to bring said right flap in closed position, in which the opening is preferably located at the pointed entry end portion of the first guide. This allows to further increase the compactness of the packaging machine.

BRIEF DESCRIPTION OF THE DRAWINGS

The present invention is described with reference to the accompanying drawings in which the same reference numbers and/or marks indicate the same parts and/or similar parts and/or corresponding parts of the system.

DETAILED DESCRIPTION OF THE INVENTION

Figure 1:
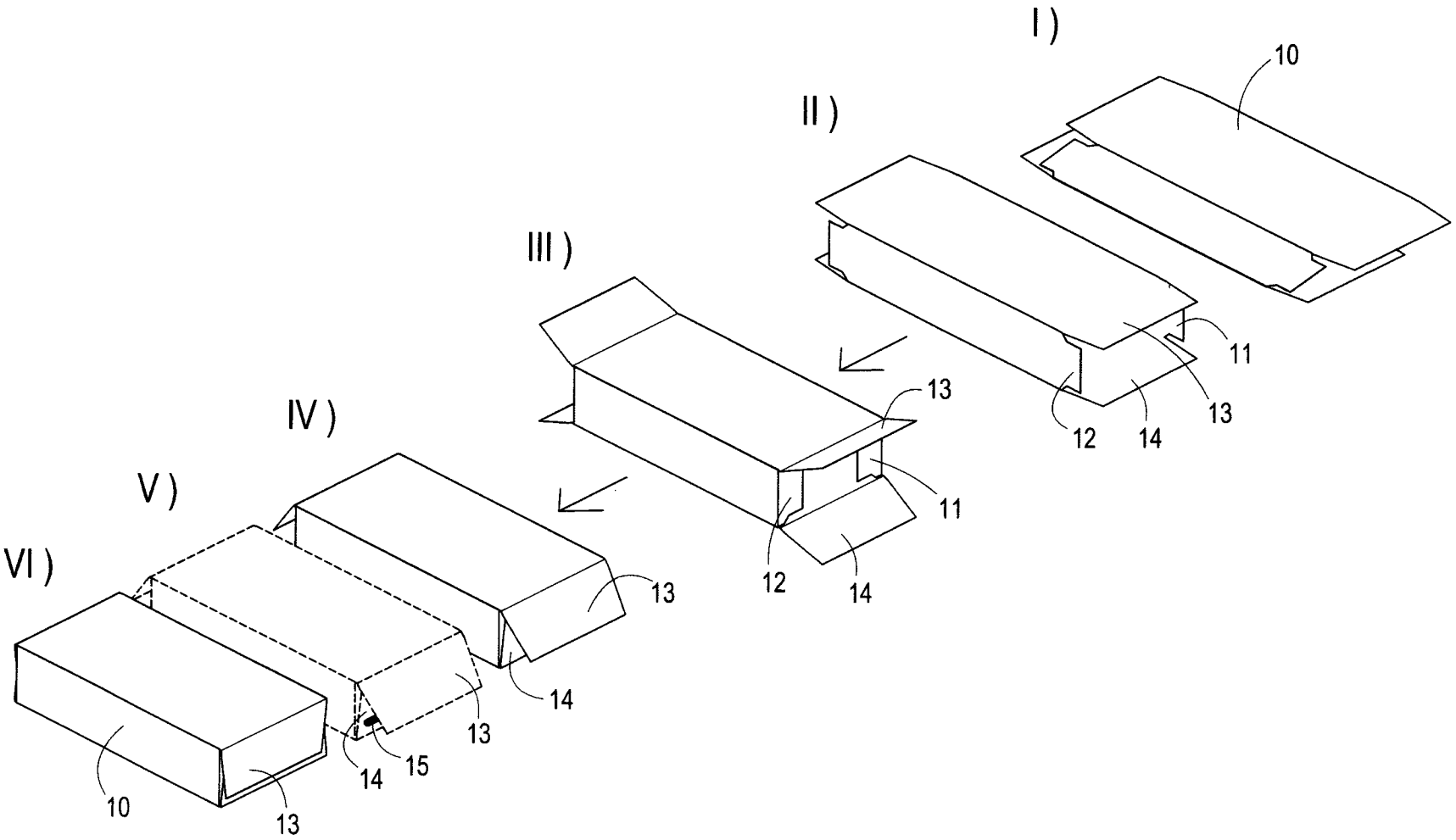
FIG. 1 schematically shows the various steps performed on a stiff package according to an embodiment of the present invention.

The present invention is described hereinbelow by making reference to particular embodiments, as illustrated in the accompanying drawings. However, the present invention is not limited to the particular embodiments described in the following detailed description and depicted in the drawings, rather the embodiments described simply exemplify the various aspects of the present invention, the scope of which is defined by the claims. Further modifications and variations of the present invention will be apparent to those skilled in art.

FIG. 1 schematically shows the various steps performed on a stiff package 10 according to an embodiment of the present invention. The various steps are performed from right to left in the figure.

The package 10 is supplied in a flat condition as schematically shown in step i) and is then unshaped so as to assume the configuration schematically shown in step ii). The package 10 can be supplied in flat condition from a flat pack warehouse. The unshaping is not the subject of the present invention. In particular, the unshaping can be carried out in any manner. For example, the unshaping can take place as described in U.S. Pat. No. 6,383,123 B1 or as described in US 2018/0297316 A1.

As schematically shown in step ii), the package 10 comprises a right flap 11, a left flap 12, an upper flap 13 and a lower flap 14. All the flaps 11, 12, 13 and 14 are in open configuration. The package 10 is then opened near the flaps 11, 12, 13 and 14. The flaps indicated with reference numbers 11, 12, 13 and 14 are the flaps placed at the end of the package 10 facing right in the figure. As can be seen in the figure, however, the package 10 comprises a second series of four flaps at the opposite end of the package 10 with respect to the end on which the flaps 11, 12, 13 and 14 are placed, that is, at the end facing left in the figure. To avoid overburdening the figures and the description, the flaps placed at the left end of the package 10 are not indicated with reference numbers but are shown only schematically in the figures. It is clear to those skilled in the art that the operations performed on the flaps 11, 12, 13 and 14 and described in detail below can also be performed on the corresponding flaps placed at the other end of the package 10. This can advantageously take place simultaneously, i.e., each operation on one of the flaps 11, 12, 13 or 14 corresponds to the same operation performed simultaneously on the corresponding flap located near the opening of the package facing left in the figure.

Step iii) shows that the upper flap 13 and the lower flap 14 are kept in an open position so as to form an angle greater than 0° with respect to the horizontal direction. This advantageously allows to fold the right flap 11 and the left flap 12 into a closed position without interfering with the upper flap 13 and/or the lower flap 14. In fact, step iii) shows that the left flap 12 and the right flap 11 have been folded into a closed position.

Step iv) shows that the lower flap 14 has been folded into a closed position so as to overlap the closed flaps 11 and 12. The upper flap 13, on the other hand, is in a predefined semi-closed position so as to only partially overlap the lower flap 14 in closed position. According to the present invention, the upper flap 13 can be brought directly from an open position, for example from the open position shown in step ii) or from that shown in step iii), to a predefined semi-closed position such as for example that shown in step iv). Alternatively, still according to the present invention, the upper flap 13 can be brought from an open position, for example from the open position shown in step ii) or from that shown in step iii), to a closed position in which the upper flap 13 completely overlaps the closed lower flap 14 and then be released so that, due to the elasticity thereof and/or by means of the pushing due to the elasticity of the lower flap 14 which tends to open, it reaches a predefined semi-closed position such as for example that shown in step iv). Both options are understood as comprised in step d) of folding the upper flap into a predefined semi-closed position as defined in the claims.

Step v) shows that glue 15 is applied to the lower flap 14 in the closed position while the upper flap 13 is kept in a predefined semi-closed position. In particular, the glue is applied to the surface of the lower flap 14 facing the outside of the package 10. Alternatively, according to the present invention, the glue 15 could be applied to the upper flap 13 while being held in the predefined semi-closed position. In this case, the glue 15 is applied to the surface of the upper flap facing the inside of the package 10. According to an alternative embodiment of the present invention, the glue 15 can be applied both on the lower flap 14 in a closed position and on the upper flap 13 in the predefined semi-closed position.

Step vi) shows that the upper flap 13 is folded in the closed position so as to fix the upper flap 13 to the lower flap 14 by means of the glue 15, so as to close the package 10.

Between step ii) and step iii) shown in FIG. 1, the objects to be packaged can be inserted into the package 10. Preferably, the objects to be packaged are inserted into the package 10 in step ii). The objects to be packaged can be inserted through the opening of the box facing right in the figure, i.e., through the opening corresponding to the flaps 11, 12, 13 and 14. Alternatively, the objects to be packaged can be inserted through the opening facing left in the figure. According to a further alternative embodiment, the objects to be packaged can be inserted through both openings.

Between step v) and step vi) shown in FIG. 1, an adjusting step of the squaring of the package 10 can be advantageously carried out. In particular, as a result of one or more of the operations carried out between steps i) and v) shown in FIG. 1 or due to the resistance of the package 10 to unshaping, the package 10 could be in a configuration which is not as perfectly squared as desired. The adjusting of the squaring can be performed immediately before closing the flap 13. Advantageously, the package 10 is kept squared while the flap 13 shown in step vi) is closed. Advantageously, a step for detecting the squaring of the package can be provided. In this case, the activation of the adjusting of the squaring can only be provided if it is detected that the package is not squared. Alternatively, in any case, a squaring adjustment step can be provided to ensure that all the packages are squared when closed.

The steps from ii) to vi) shown in FIG. 1 can be carried out continuously, i.e., with the packages 10 travelling continuously, without stopping, in the various steps. Alternatively, the steps can be performed alternately, i.e., with the packages 10 temporarily pausing in one or more of the various steps for a sufficient amount of time to carry out the operations of the specific step.

Figure 2:
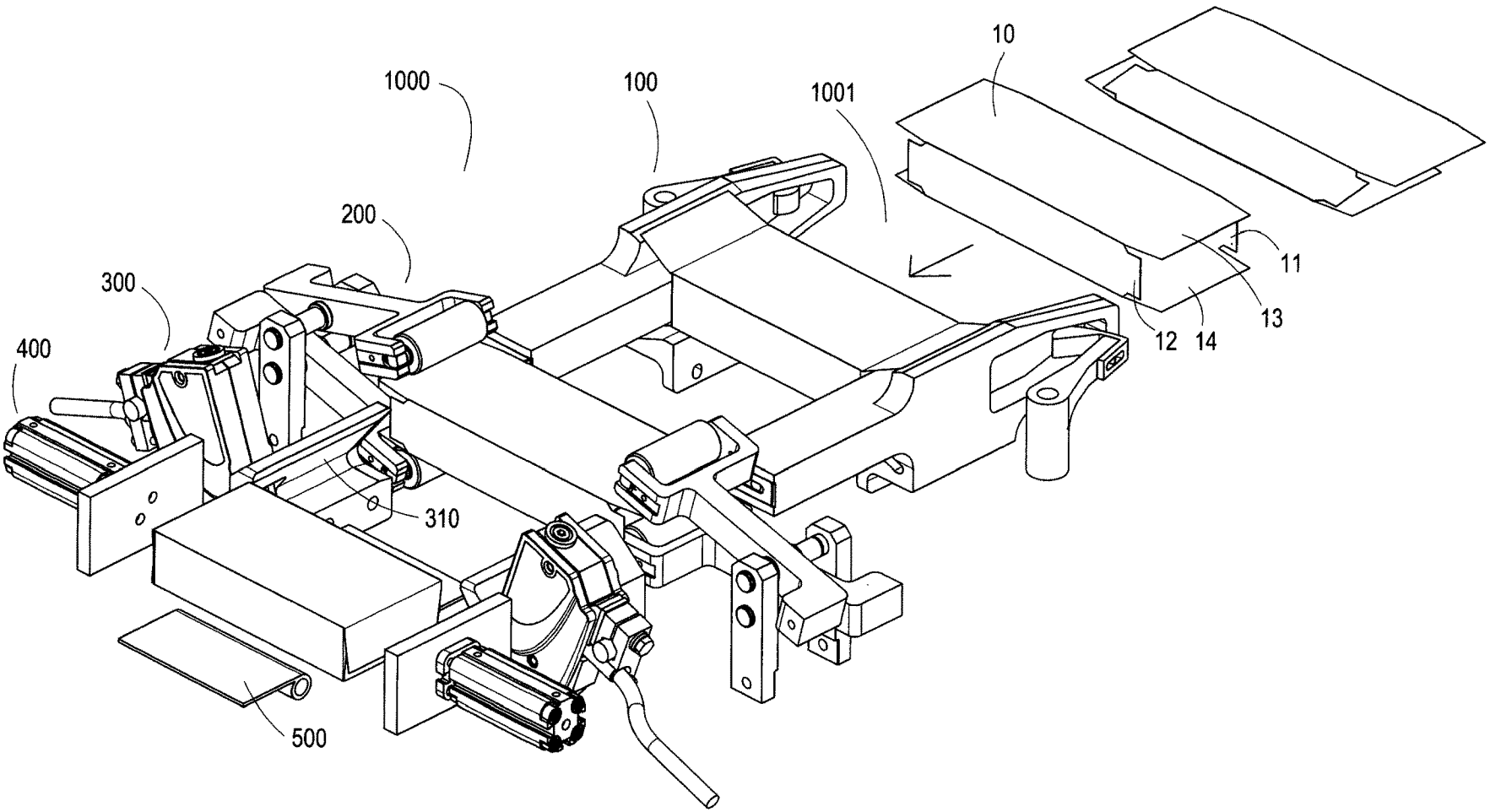
FIG. 2 schematically shows a packaging machine according to an embodiment of the present invention.

FIG. 2 schematically shows a packaging machine 1000 according to a particular embodiment of the present invention. The packaging machine 1000 comprises the four operative stations indicated with the reference numbers 100, 200, 300 and 400 and described in detail below. FIG. 2 also indicates the transportation line 1001 along which the packages 10 are transported to the various operative stations of the packaging machine 1000. The transportation direction is from right to left in FIG. 2. The transportation line 1001 can be defined for example by a catenary or a conveyor belt configured to house and transport the packages 10 to the various operative stations. The catenary or the conveyor belt can be operated continuously, i.e., so that the packages travel continuously through the various operative stations without stopping at them, or alternatively, i.e., so that the packages stop at the various operative stations for a sufficient amount of time to carry out the operations foreseen at the various stations.

Figure 3A:
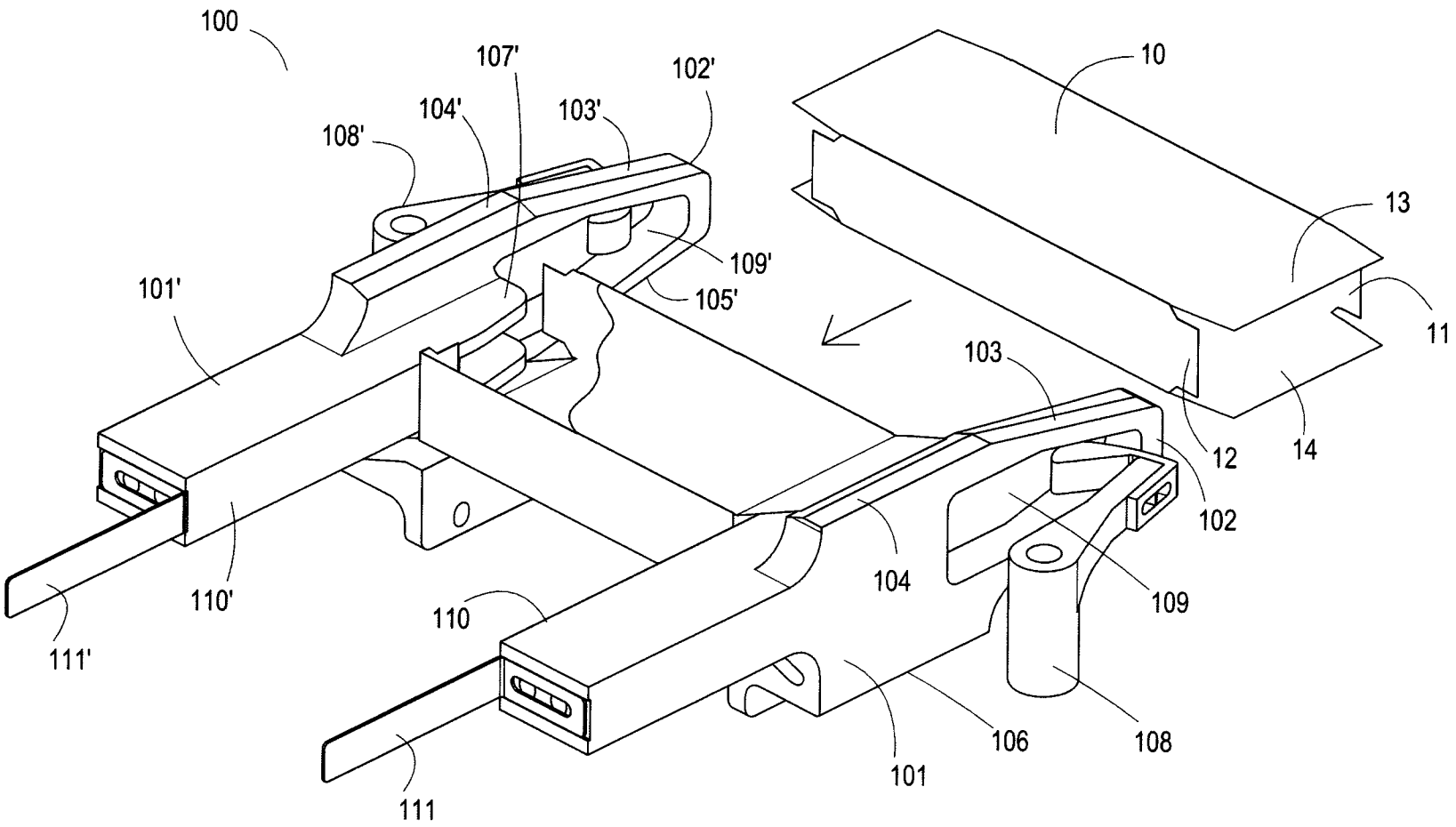
FIG. 3A schematically shows the first operative station of the packaging machine of FIG. 2 in an operative step.

FIG. 3A schematically shows the first operative station 100 of the packaging machine of FIG. 2 in an operative step.

The first operative station 100 receives the package 10 at the entry thereof after it has been unshaped and in an open configuration, i.e., with all the flaps in the open position. The first operative station 100 is configured to fold the left flap 12 and the right flap 11 into a closed position. Furthermore, in the particular embodiment shown in FIG. 3A, the first operative station 100 is configured to open and keep the upper flap 13 and the lower flap 14 in an open position so as to form an angle greater than 0° with respect to the horizontal direction. This advantageously allows folding the right flap 11 and the left flap 12 into a closed position without interfering with the upper flap 13 and/or the lower flap 14.

The first operative station 100 comprises a first guide 101 which has a pointed entry end portion 102 of the packages 10 so that when the packages travel along the first guide 101 the upper flap 13 and the lower flap 14 are brought to an open position so as to form an angle greater than 0° with respect to the horizontal direction.

In particular, the entry end portion 102 comprises an upper inclined side 103 configured to open the upper flap 13 so as to form an angle greater than 0° with respect to the horizontal direction when the package 10 travels along the guide 101. The upper inclined side 103 is then joined to an upper horizontal side 104 which keeps the upper flap 13 in this position while the flap travels and slides along this upper horizontal side 104.

The entry end portion 102 further comprises a lower inclined side 105 configured to open the lower flap 14 so as to form an angle greater than 0° with respect to the horizontal direction when the package 10 travels along the guide 101. The lower inclined side 105 is then joined to a lower horizontal side 106 which keeps the lower flap 14 in this position while the flap travels and slides along this lower horizontal side 106.

The first guide 101 further comprises a protrusion configured so as to close the left flap 12 of the package 10 when the package 10 travels and slides along the first guide 101. The protrusion is not visible in the figure but the corresponding, protrusion 107' of the second guide 101' of the first station 100, mirroring the first guide 101, is visible. The left flap 12 is not only brought from the open position to the closed position by means of the protrusion but is also kept in this position by the extension 110 of the protrusion while the package 10 travels along the first guide 101. The extension 110 has an end portion 111 which extends into the area of the second operative station 200 of the packaging machine 1000.

Figure 3B:
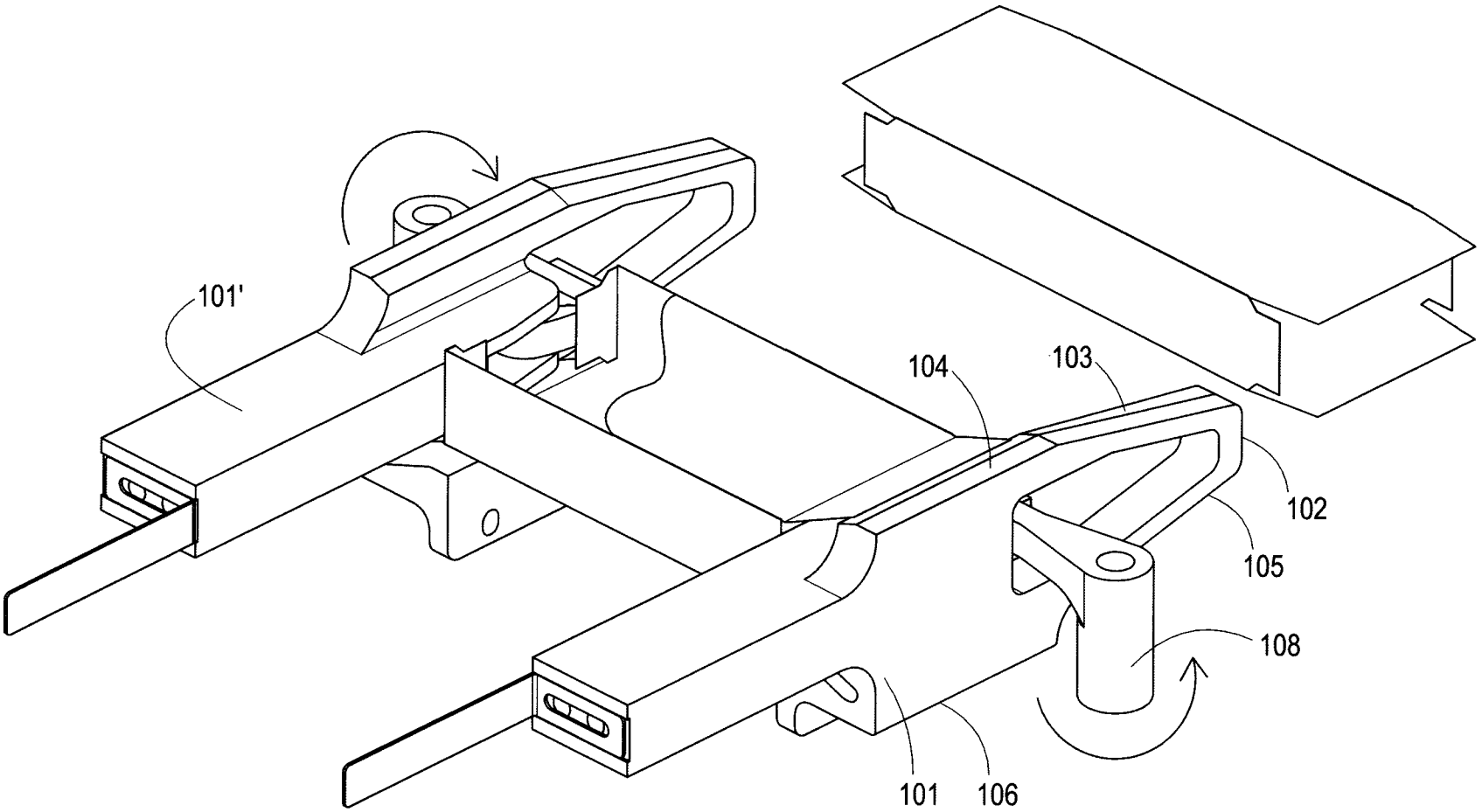
FIG. 3B schematically shows the first operative station of the packaging machine of FIG. 2 in a further operative step.

The first station 100 also comprises pushing means 108 configured to fold the right flap 11 of the package 10 when the package 10 travels along the guide 101. The guide 101 comprises an opening 109 configured for housing the pushing means 108. The pushing means 108 rotate through the opening 109 and push the right flap 11 from the open position to the closed position. The rotation of the pushing means 108 is shown in FIG. 3B. Subsequently, during the travel of the package 10 along the guide 101, the right flap 11 abuts the protrusion of the guide 101 and the extension 110 thereof and is therefore kept in closed position. The opening 109 of the first guide 101 is placed in the area of the first guide 101 delimited by the upper inclined side 103, the lower inclined side 105 and at least a part of the upper horizontal side 104 and the lower horizontal side 106. In this manner, an extremely compact configuration of the first guide 101 is obtained despite the multiplicity of operations which are carried out therethrough.

FIGS. 3A and 3B show that the packaging machine also comprises a second guide 101' which mirrors the first guide 101. The second guide 101' is configured to carry out the various steps described above on the flaps located at the opening of the package 10 facing left in FIGS. 3A and 3B. The second guide 101' includes pointed entry end portion 102', upper inclined side 103', upper horizontal side 104', lower inclined side 105', lower horizontal side 106', corresponding protrusion 107' extension 110', and end portion 111'.

Figure 4A:
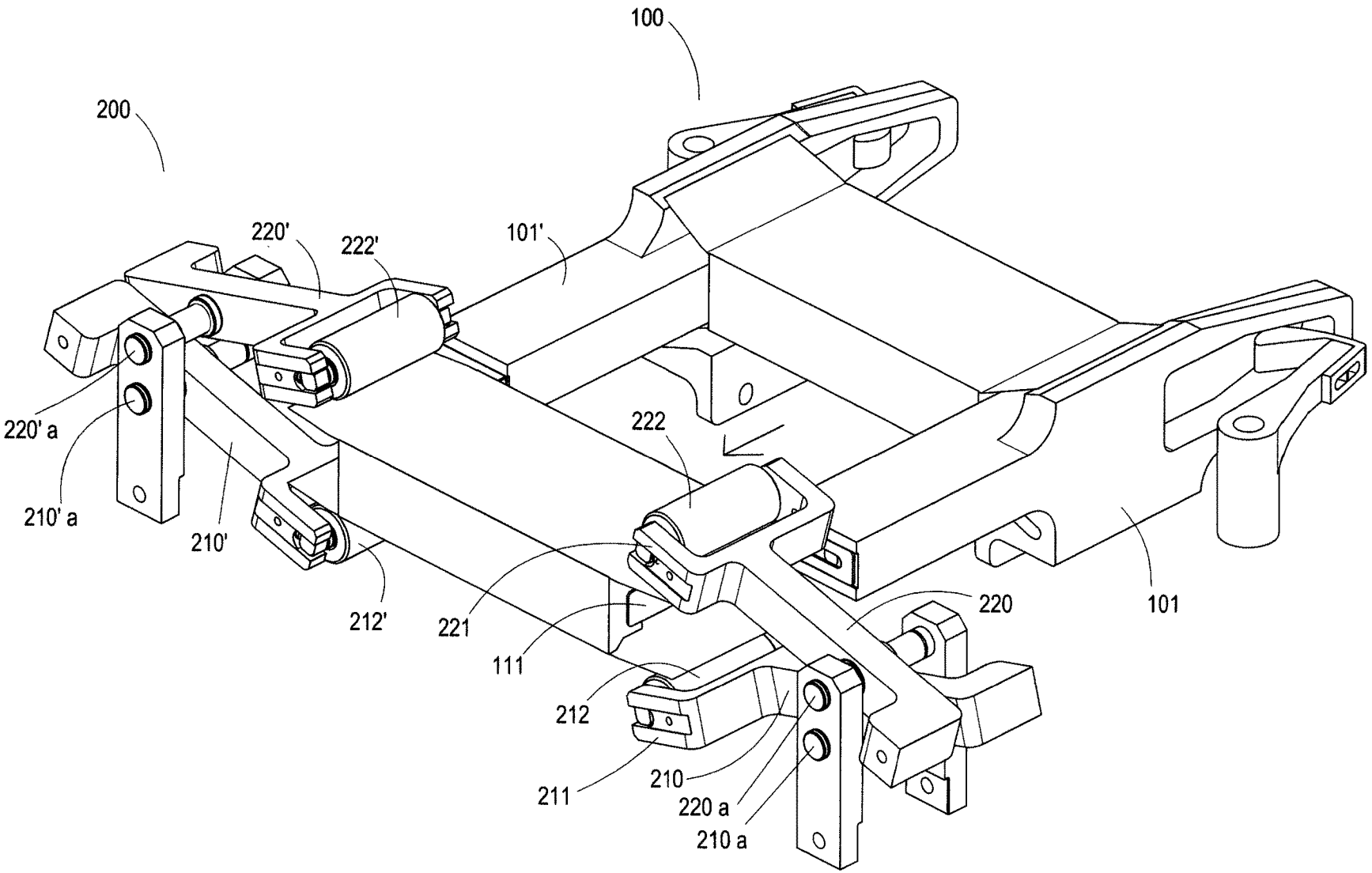
FIG. 4A schematically shows the second operative station of the packaging machine of FIG. 2 in an operative step.

FIG. 4A schematically shows the second operative station 200 of the packaging machine of FIG. 2 in an operative step. The second operative station 200 is located downstream of the first operative station 100 along the transportation line 1001 of the packaging machine 1000. In particular, the second operative station 200 is placed at the end 111 of the first guide 101 of the first operative station 100.

The second operative station 200 comprises a first arm 210 configured to rotate around an axis 210*a*. The first arm 210 has an end portion 211 to which a roll 212 is mounted. When the first arm 210 rotates around the axis 210*a*, the roll 212 rolls along the surface of the lower flap 14 so as to bring it in closed position (see FIG. 4B).

The second operative station 200 further comprises a second arm 220 configured to rotate around an axis 220*a*. The second arm 220 has an end portion 221 to which a roll 222 is mounted. When the second arm 220 rotates around the axis 220*a*, the roll 222 rolls along the surface of the upper flap 13 so as to bring it either in closed position or in a predefined semi-closed position (see FIG. 4C).

If the second arm 220 is made to rotate so as to bring the upper flap 13 in closed position, the elasticity of the flap 13 itself and/or the pushing of the lower closed flap 14 is then exploited to bring the upper flap 13 to the predefined semi-closed position. In fact, when the second arm 220 releases the upper flap 13 this will tend to reopen. The packaging machine 1000 is therefore equipped with the guide 310 described in detail below and configured so as to stop the reopening of the upper flap 13 and therefore to keep it in the predefined semi-closed position.

The rolls 212 and 222 are mounted at the end portions 211 and 221 of the first arm 210 and of the second arm 220, by means of springs 213 and 223, respectively. The springs 213 and 223 allow a reversible displacement of the rotation axis of the corresponding roll so that the pressure exerted by the roll on the corresponding flap is not excessive, so as to avoid damaging the flap during closure. For example, the rolls are made of soft and/or elastic material, for example rubber, so as to minimize the probability of damaging the flaps during closure.

Figure 4B:
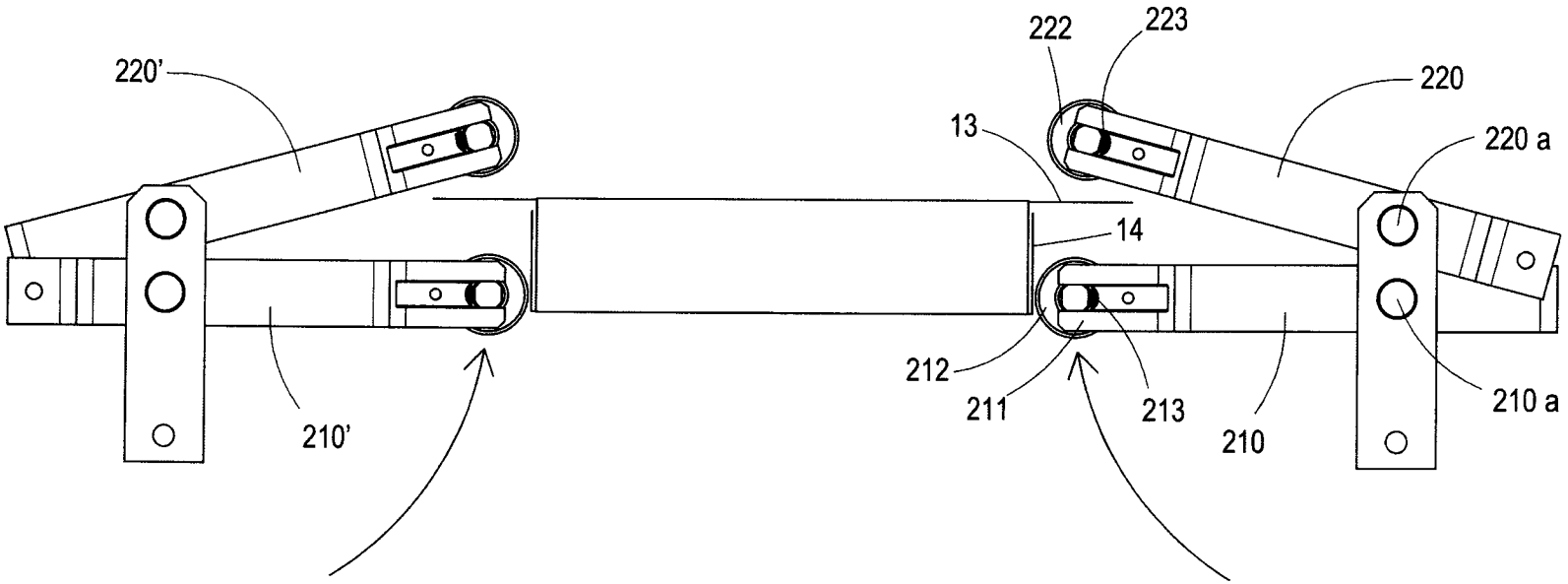
FIG. 4B schematically shows the second operative station of the packaging machine of FIG. 2 in a further operative step.
Figure 4C:
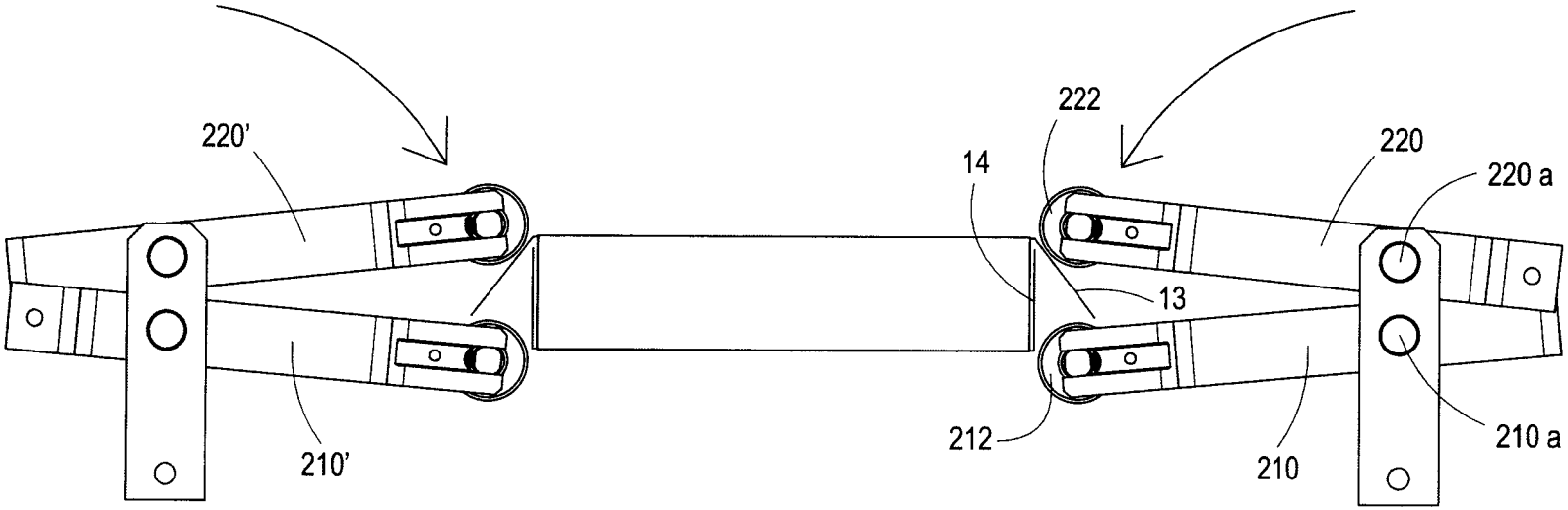
FIG. 4C schematically shows the second operative station of the packaging machine of FIG. 2 in a further operative step.

Similarly to FIGS. 3A and 3B, also FIGS. 4A to 4C show that the packaging machine 1000 also comprises a third arm 210' which mirrors the first arm 210 and a fourth arm 220' which mirrors the second arm 220 to carry out the various steps described above on the flaps placed at the opening of the package 10 facing left in the figure. The third arm 210' has an axis 210'*a* and roll 212'. The fourth arm 220' has an axis 220'*a* and a roll 222'.

Figure 5A:
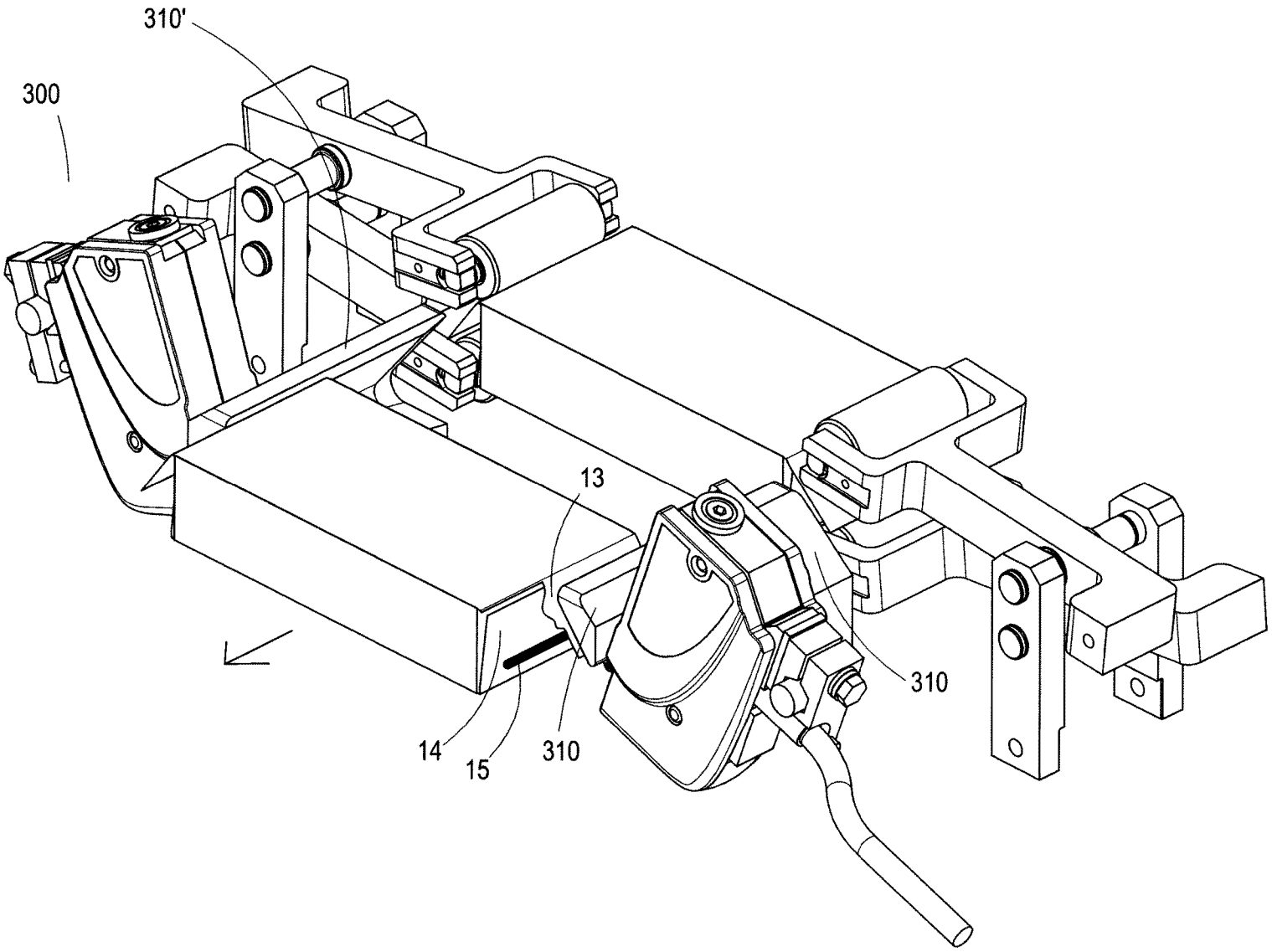
FIG. 5A schematically shows the third operative station of the packaging machine of FIG. 2 in a perspective view.
Figure 5B:
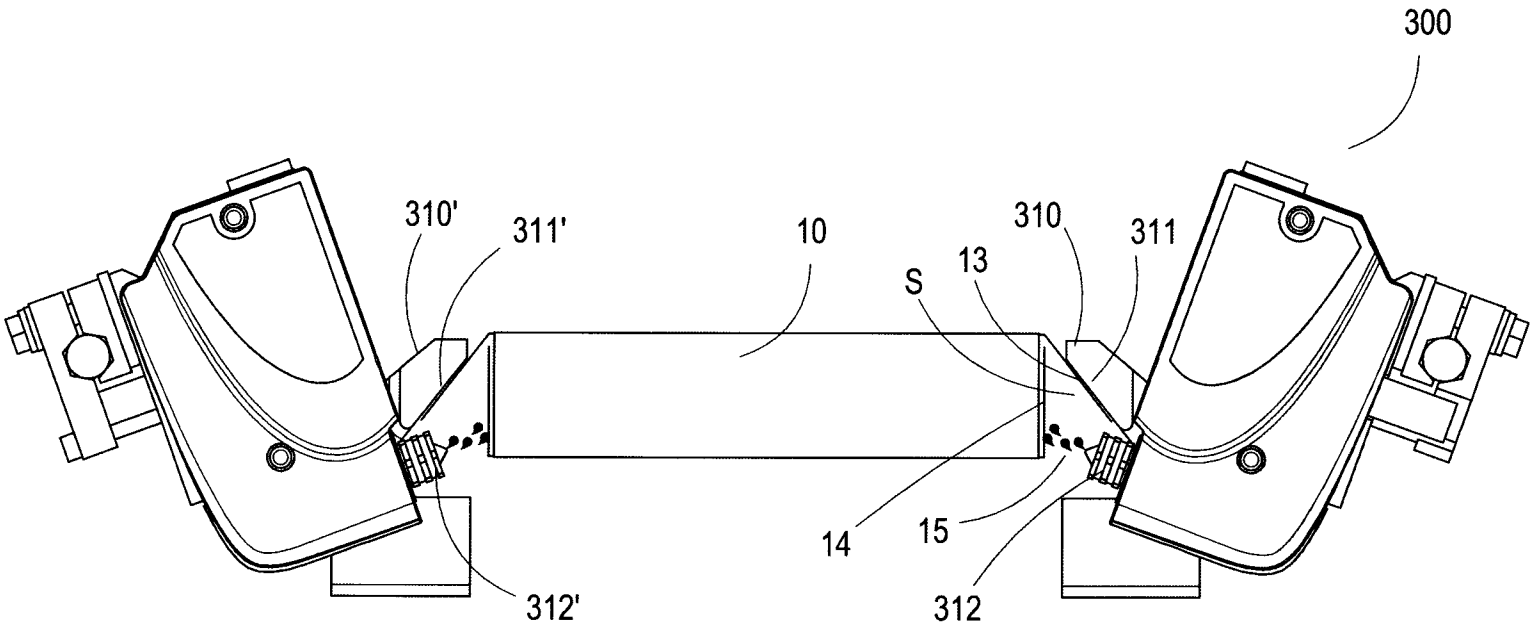
FIG. 5B schematically shows the third operative station of the packaging machine of FIG. 2 in a side view.

FIG. 5A schematically shows the third operative station 300 of the packaging machine 1000 of FIG. 2 in a perspective view. FIG. 5B schematically shows the third operative station 300 of the packaging machine of FIG. 2 in a side view.

The third operative station 300 is located downstream of the second operative station 200 along the transportation line 1001 of the packaging machine 1000.

The third operative station 300 comprises a guide 310 configured to keep the upper flap 13 in the predefined semi-closed position during the transportation of the package 10 from the second operative station 200 to the third operative station 300. The guide 310 is also configured to keep the upper flap 13 in this position also when the package is at the third operative station 300. The guide 310 comprises an inclined surface 311 facing the upper flap 13. The angle of inclination of the inclined surface 311 is selected so that the upper flap 13 remains in the predefined semi-closed position. In fact, the upper flap 13 tends to reopen, both due to the elasticity thereof and due to the pushing of the lower flap 14 which in turn tends to open due to the elasticity thereof. The inclined surface 311 stops the upper flap 13 in the predefined semi-open position.

The guide 310 then extends as far as the exit of the second operative station 200 so that the possible reopening of the upper flap 13 following the closing by means of the first arm 210 is stopped at the predefined semi-closed position.

When the package 10 travels from the second operative station 200 to the third operative station 300, the end 111 of the guide 101 of the first operative station 100 is removed from the flaps. The side flaps 11 and 12 remain in any case in the closed position due to the pressure exerted by the closed lower flap 14 which, in turn, remains in the closed position due to the pressure exerted by the upper flap 13 kept in a semi-closed position by the guide 310.

As can be seen in FIG. 5B, keeping the upper flap 13 in the semi-closed position creates a free space S which can be exploited for the application of the glue 15.

In particular, in the embodiment shown in FIG. 5B, the third operative station 300 comprises glue application means 312, for example a nozzle in communication with a reservoir of glue, configured to apply glue to the lower flap 14 in closed position. The end of the nozzle is placed in the free space S and is turned towards the lower flap 14 placed in closed position, in particular towards the surface of the lower flap 14 facing the outside of the package 10. In this manner, the glue 15 is applied to the outer surface of the lower flap 14.

According to an alternative embodiment of the invention not shown in the figure, the glue application means 312 can be configured to apply glue to the upper flap 13 placed in a predefined semi-closed position. In particular, in this case, the nozzle in communication with the glue reservoir can be placed in the free space S but be turned towards the inner surface of the upper flap 13, i.e., towards the surface of the flap 13 facing the inside of the package 10.

The glue application means 312 are placed below the inclined surface 311 of the guide 310 so as to be in the free space S formed between the lower flap 14 in closed position and the upper flap 13 maintained in predefined semi-closed position by the surface 311 of the guide 310.

Also in this case, FIGS. 5A and 5B show that the third operative station 300 of the packaging machine 1000 comprises the elements 310', 311' and 312', which respectively mirror the elements 310, 311 and 312 so as to perform the various steps described above on the flaps placed at the opening of the package 10 facing left in the figure.

Figure 6A:
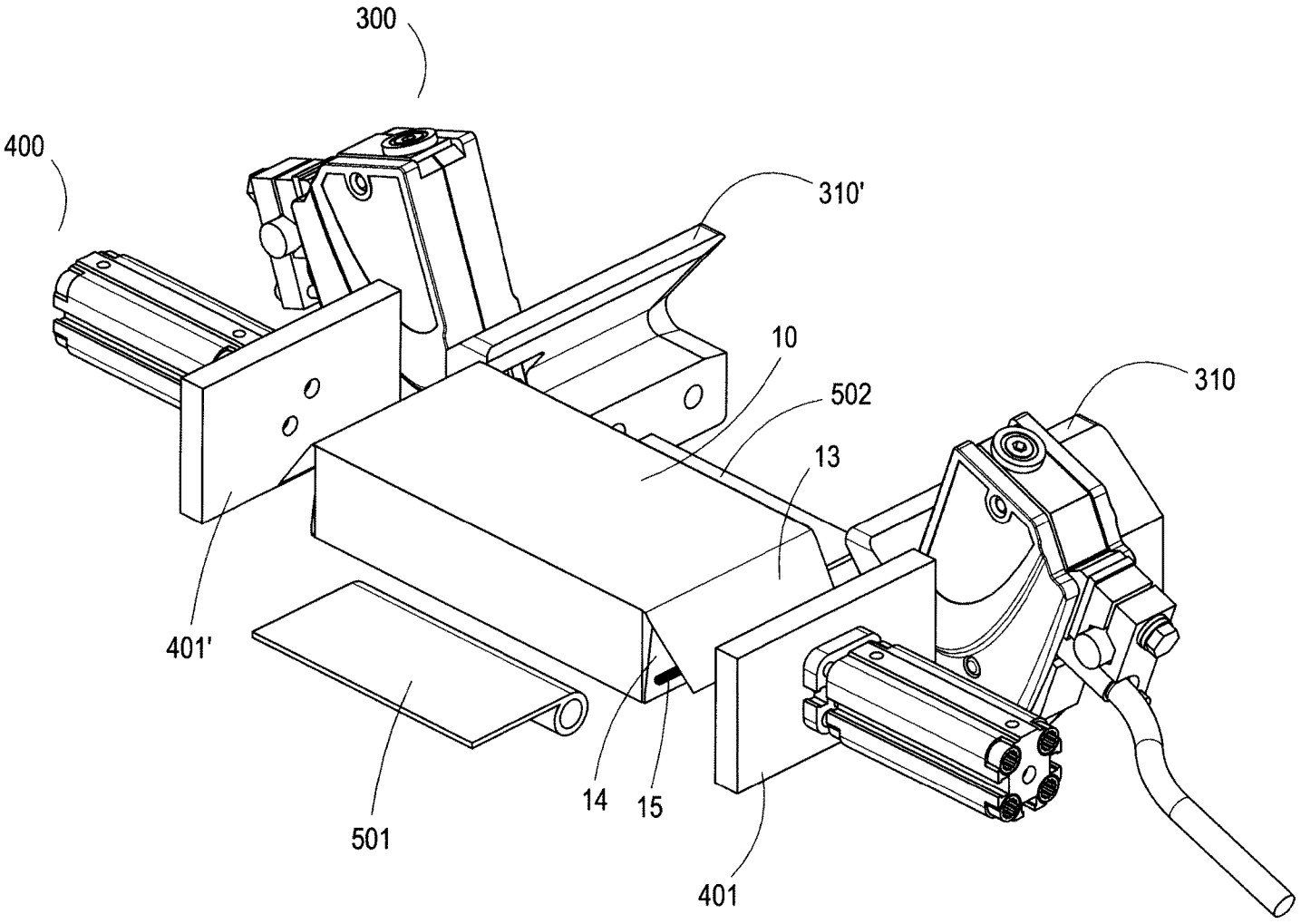
FIG. 6A schematically shows the fourth operative station of the packaging machine of FIG. 2 in an operative step.

FIG. 6A schematically shows the fourth operative station 400 of the packaging machine of FIG. 2 in an operative step.

The fourth operative station 400 is located downstream of the third operative station 300 along the transportation line 1001 of the packaging machine 1000.

The fourth operative station 400 is configured to fold the upper flap 13 from the predefined semi-closed position obtained by the third operative station 300 to the closed position in which the upper flap 13 is fixed to the lower flap 14 so that the package 10 is closed. The fourth operative station 400 comprises in particular pushing means 401 which can be actuated so as to close the upper flap (see FIG. 6C).

At the operative station 400 there are also means for adjusting the squaring 500, illustrated in FIG. 2, of the packages 10. In particular, the adjusting means 500 comprise a first guide 501 and a second guide 502. The first guide 501 and the second guide 502 are placed transversally to the transportation direction of the packages 10 along the transportation line 1001. The first guide 501 and the second guide 502 can be rotated from a horizontal position which allows the passage of the packages 10 (see FIG. 6A) to a vertical squaring position of the packages 10 (see FIGS. 6B and 6C). In the vertical squaring position the first guide 501 and the second guide 502 oppose the side walls of the package 10 so as to square the possibly not squared packages and in such a way as to keep the packages squared.

Figure 6B:
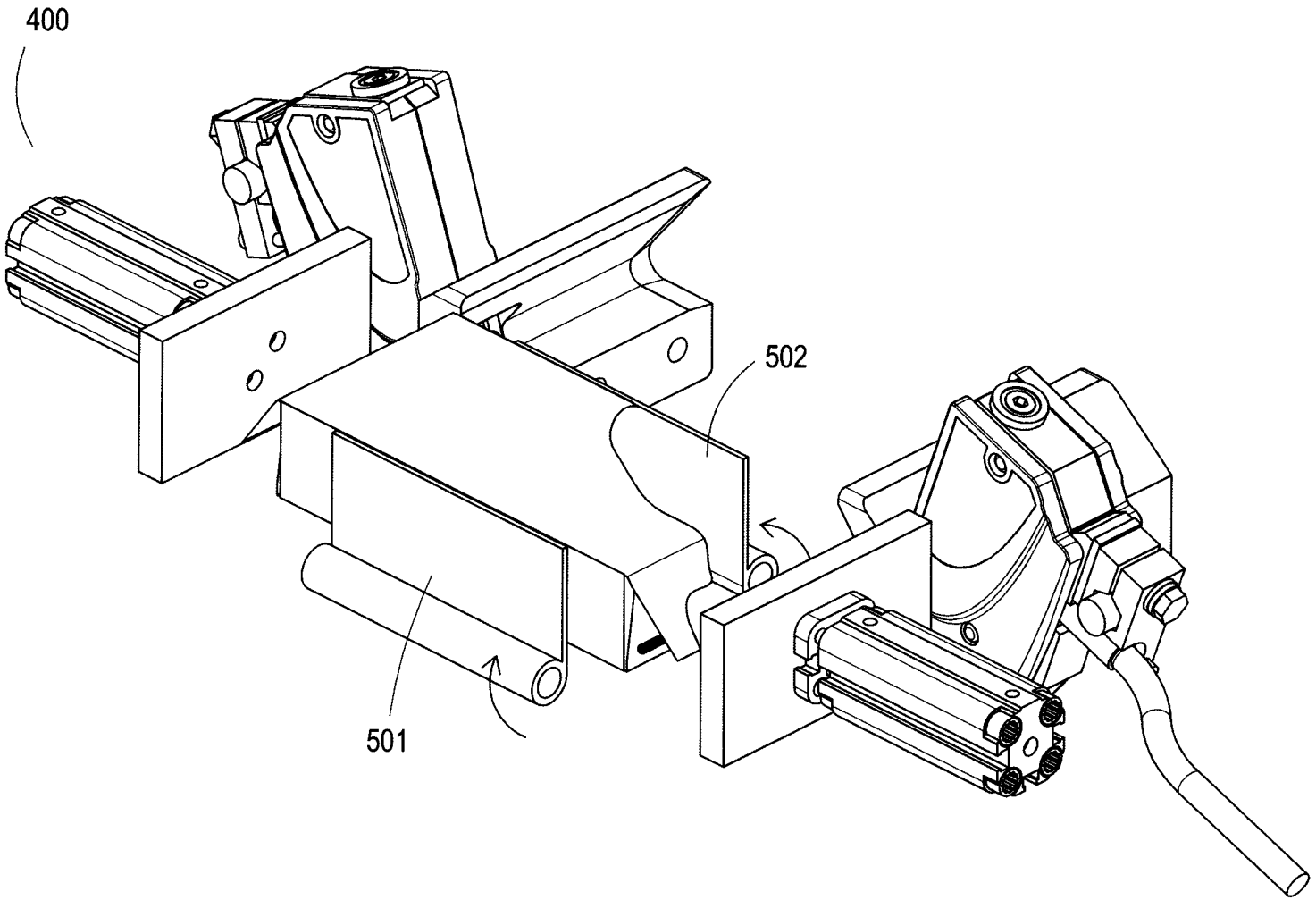
FIG. 6B schematically shows the fourth operative station of the packaging machine of FIG. 2 in a further operative step.
Figure 6C:
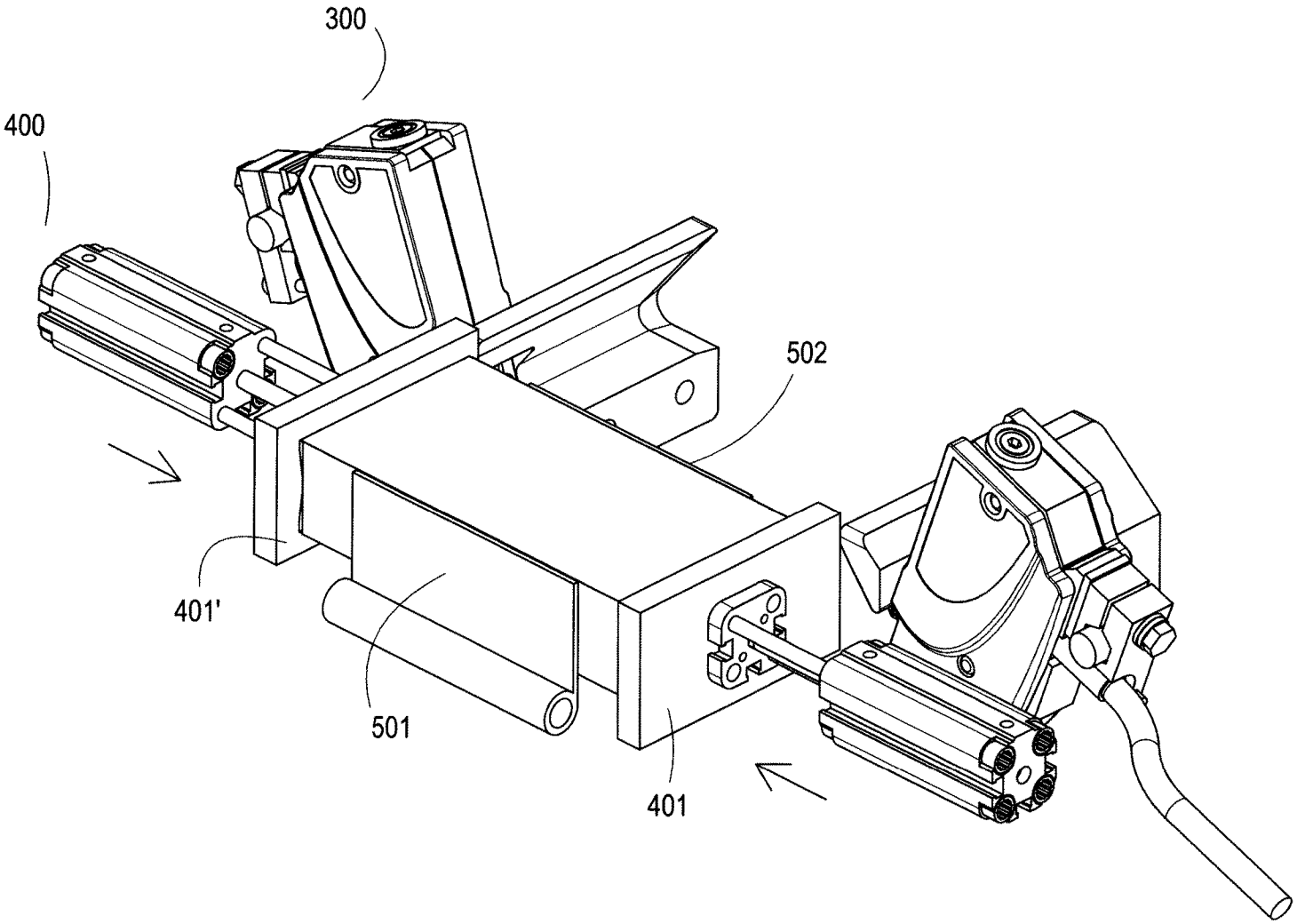
FIG. 6C schematically shows the fourth operative station of the packaging machine of FIG. 2 in a further operative step.

In fact, as shown in FIG. 6C, the package 10 is advantageously closed while the guides 501 and 502 are in a vertical squaring position so as to keep the package 10 squared while the upper flap 13 is fixed to the lower flap 14. This allows to avoid closing packages which are not squared.

Also in this case, FIGS. 6A to 6C show that the fourth operative station 400 of the packaging machine 1000 comprises the element 401' which mirrors the element 401 so as to carry out the various steps described above on the flaps placed at the opening of the package 10 facing left in the figure.

From the description it results that the packaging machine according to the present invention can be made particularly compact. Furthermore, the packaging machine according to the present invention operates in a simple and effective manner.

Although the present invention was described with reference to the embodiments described above, it is apparent to an expert in the field that it is possible to make several modifications, variants and improvements to the present invention in light of the above teaching and within the scope of the appended claims, without departing from the object and the scope of protection of the invention.

For example, the present invention can be implemented with stiff packages of various sizes, for example with carton boxes, such as for example carton boxes for containing a certain number of capsules for the production of beverages, for example 10, or with larger boxes, for example boxes to contain a certain number of carton boxes which in turn contain a certain number of capsules for the production of beverages.

Finally, those fields known by experts in the field were not described to avoid excessively and uselessly overshadowing the invention described.

Accordingly, the invention is not limited to the embodiments described above, but is only limited by the scope of protection of the appended claims.

What is claimed is:

1. Method for packaging objects in a stiff package, for example in a carton box or in a box, along a transportation line, wherein the stiff package comprises a right flap, a left flap, an upper flap and a lower flap, wherein said method comprises the following steps:

a) folding the left flap in a closed position;

b) folding the right flap in a closed position;

c) folding the lower flap in a closed position so that the lower flap overlaps the left flap and the right flap in closed position;

d) folding the upper flap in a predefined semi-closed position so that the upper flap partially overlaps said lower flap in the closed position;

e) applying glue to at least one of the lower flap in the closed position and the upper flap in the predefined semi-closed position;

f) folding the upper flap in a closed position so as to fix the upper flap to the lower flap by means of the glue; and g) adjusting the squaring of the stiff package by means of adjusting means comprising a first guide and a second guide, wherein said first guide and said second guide are transversally placed with respect to a transportation direction of the packages along the transportation line and are rotatable from a horizontal position that allows passage of the packages to a vertical squaring position and wherein said first guide and said second guide are placed in correspondence with said fourth operative station, wherein said step g) is carried out between said step e) and said step f).

2. Method according to claim 1, wherein during said steps a) and b) the upper flap and the lower flap are kept in an open position wherein each of the upper flap and the lower flap forms an angle greater than 0° with respect to a horizontal direction so that the left flap and the right flap do not interfere with the upper flap and the lower flap during said folding of said steps a) and b).

3. Method according to claim 1, wherein the stiff package is kept square while said step f) is carried out.

4. Packaging machine for packaging objects in stiff packages, for example in a carton box or in a box, along a transportation line, wherein said stiff package comprises a right flap, a left flap, an upper flap and a lower flap, wherein said packaging machine comprises:

a first operative station configured to fold the left flap and the right flap in a closed position;

a second operative station configured to fold the lower flap in a closed position so that the lower flap overlaps the right flap and the left flap in closed position and to fold said upper flap in a predefined semi-closed position so that the upper flap partially overlaps the lower flap in closed position;

a third operative station configured to apply glue to at least one of the lower flap in closed position and the upper flap in semi-closed position;

a fourth operative station configured to fold the upper flap in a closed position so as to fix the upper flap to the lower flap by means of the glue, and wherein said machine further comprises adjusting means for adjusting squaring of the stiff packages wherein said adjusting means are configured to adjust the squaring of the stiff packages after glue has been applied at said third operative station and before the upper flap is folded at said fourth operative station, and wherein said adjusting means comprise a first guide and a second guide, wherein said first guide and said second guide are transversally placed with respect to a transportation direction of the packages along the transportation line and are rotatable from a horizontal position that allows passage of the packages to a vertical squaring position and wherein said first guide and said second guide are placed in correspondence with said fourth operative station.

5. Packaging machine according to claim 4, wherein said second operative station comprises a first arm configured to rotate around an axis so that an end portion of said first arm pushes the lower flap from an open position to the closed position and a second arm configured to rotate around an axis so that an end portion of said second arm pushes the upper flap from an open position to a closed position wherein the upper flap overlaps the lower flap in closed position.

6. Packaging machine according to claim 5, wherein at least one or both of the end portions of said first arm and of said second arm is provided with a roll configured to roll along the surface of the lower flap or the upper flap during said roll rotation while said first arm and/or said second arm rotate to push the lower flap or the upper flap, respectively.

7. Packaging machine according to claim 6, wherein said roll is mounted to said end portion of said first arm and/or of said second arm by a spring so that a rotation axis of said roll is displaceable in a reversible manner.

8. Packaging machine according to claim 4, wherein said third operative station comprises a guide configured to keep the upper flap in the predefined semi-closed position during transportation of said packages from said second operative portion to said third operative portion.

9. Packaging machine according to claim 8 further comprising glue application means placed underneath said guide so as to be located in a free space formed by the lower flap in closed position and the upper flap in the predefined semi-closed position.

10. Packaging machine according to claim 4, wherein said adjusting means are configured to keep the stiff packages in square while the upper flap is folded at said fourth operative station.

11. Packaging machine according to claim 4, wherein said first operative station comprises a first guide with a pointed entry end portion so that when the packages travel along said first guide the upper flap and the lower flap are brought to an open position wherein the upper flap and the lower flap form an angle greater than 0° with respect to a horizontal direction.

12. Packaging machine according to claim 11, wherein said first guide further comprises a protrusion so that when the packages travel along said first guide the left flap is brought to the closed position.

13. Packaging machine according to claim 11, wherein said first guide further comprises an opening for housing pushing means configured to rotate so as to bring the right flap in closed position, wherein said opening is located in correspondence with said pointed entry end portion.

14. A packaging machine for packaging objects in stiff packages transported along a transportation line, wherein the stiff packages each comprise a right flap, a left flap, an upper flap, and a lower flap, said packaging machine in order along the transportation line, comprising:

a first operative station configured to fold the left flap and the right flap in a closed position;

a second operative station configured to fold the lower flap in a closed position so that the lower flap overlaps the right flap and the left flap and to fold the upper flap in a predefined semi-closed position so that the upper flap partially overlaps the lower flap;

a third operative station configured to apply glue to at least one of the lower flap and the upper flap in the predefined semi-closed position;

a fourth operative station;

a first rotatable guide positioned and confined in said fourth operative station and aligned transverse to a direction of travel of the transportation line, said first rotatable guide configured to rotate to a horizontal position parallel to the transportation line allowing passage of one of the stiff packages past the first rotatable guide, said first rotatable guide configured to rotate to a first guide vertical squaring position extending above the transportation line and positioned adjacent a side wall of the one of the stiff packages;

a second rotatable guide positioned and confined in said fourth operative station and aligned transverse to a direction of travel of the transportation line separated a distance from said first rotatable guide, said second rotatable guide configured to rotate to a horizontal position parallel to the transportation line allowing passage of the one of the stiff packages past the second rotatable guide, said second rotatable guide configured to rotate toward said first rotatable guide to a second guide vertical squaring position extending above the transportation line and positioned adjacent an opposing side wall of the one of the stiff packages;

wherein said first guide is configured to rotate to the first guide vertical squaring position adjacent the side wall of the one of the stiff packages and said second guide is configured to rotate to the second guide vertical squaring position adjacent the opposing side wall of the one of the stiff packages; and wherein said fourth operating station is configured to fold the upper flap in a closed position fixing the upper flap to the lower flap after rotation of said first rotatable guide to the first guide vertical squaring position and rotation of said second rotatable guide to the second guide vertical squaring position, whereby the one of the stiff packages positioned between the first rotatable guide and the second rotatable guide is capable of being squared when said first and second rotatable guides rotate towards each other prior to fixing the upper flap to the lower flap.

* * * * *